US006095762A

United States Patent [19]

Wheeler

[11] Patent Number: 6,095,762

[45] Date of Patent: Aug. 1, 2000

[54] COMPRESSOR MECHANISM FOR A PORTABLE BATTERY OPERATED INFLATOR

[75] Inventor: Thomas J. Wheeler, Baltimore, Md.

[73] Assignee: Black & Decker Inc., Newark, Del.

[21] Appl. No.: 08/907,524

[22] Filed: Aug. 8, 1997

[51] Int. Cl.[7] ..... F04B 21/00

[52] U.S. Cl. ..... 417/275

[58] Field of Search ..... 417/275, 213, 417/274, 460, 469

[56] References Cited

U.S. PATENT DOCUMENTS

| | | |
|---|---|---|
| Re. 32,995 | 7/1989 | Fair . |
| 530,442 | 12/1894 | Munger . |
| 1,178,978 | 4/1916 | Wainwright . |
| 1,370,254 | 3/1921 | Yearsley . |
| 1,493,325 | 5/1924 | Donaldson . |
| 1,528,172 | 3/1925 | Voss . |
| 1,611,789 | 12/1926 | Spreen . |
| 1,634,949 | 7/1927 | Le Valley . |
| 1,645,788 | 10/1927 | Boies . |
| 1,799,103 | 3/1931 | Klimek . |
| 1,941,048 | 12/1933 | Punte . |
| 1,967,418 | 7/1934 | McPhail . |
| 2,062,206 | 11/1936 | Browne . |
| 2,112,106 | 3/1938 | Longstreet . |
| 2,139,313 | 12/1938 | Neubauer . |
| 2,223,944 | 12/1940 | Roy . |
| 2,243,123 | 5/1941 | Ritter . |
| 2,339,048 | 1/1944 | Bixler . |
| 2,373,046 | 4/1945 | Osborn, Jr. . |
| 2,380,597 | 7/1945 | Hess . |
| 2,423,677 | 7/1947 | Balogh . |
| 2,506,751 | 5/1950 | Trask . |
| 2,521,313 | 9/1950 | Sproat . |
| 2,570,965 | 10/1951 | Meyers . |
| 2,576,687 | 11/1951 | Krehbiel . |
| 2,579,667 | 12/1951 | Hanson . |
| 2,592,343 | 4/1952 | Scheldorf . |
| 2,622,792 | 12/1952 | Ramclow . |
| 2,728,351 | 12/1955 | Cooper . |
| 2,804,259 | 8/1957 | Ralston . |
| 2,856,116 | 10/1958 | Hogan . |
| 2,948,296 | 8/1960 | Thorburn . |
| 2,951,370 | 9/1960 | Robinson . |
| 2,984,408 | 5/1961 | Nicholas . |

(List continued on next page.)

FOREIGN PATENT DOCUMENTS

| | | |
|---|---|---|
| 0 041 225 A1 | 12/1981 | European Pat. Off. . |
| 0 611 888 B1 | 8/1994 | European Pat. Off. . |
| 1 814 416 | 6/1970 | Germany . |
| 1 653 791 | 4/1973 | Germany . |
| 7518529 | 10/1975 | Germany . |
| G 81 21 571 | 12/1981 | Germany . |
| 31 43 290 A1 | 5/1983 | Germany . |
| G 84 13 935 | 10/1984 | Germany . |
| G 85 27 315 | 1/1986 | Germany . |
| 36 10 884 A1 | 10/1987 | Germany . |
| 43 24 816 A1 | 1/1995 | Germany . |
| 296 00 321 U1 | 4/1996 | Germany . |

*Primary Examiner*—Timothy S. Thorpe
*Assistant Examiner*—Liem Nguyen
*Attorney, Agent, or Firm*—Harness, Dickey & Pierce P.L.C.

[57] ABSTRACT

An inflator mechanism has a valve adapted to secure with the device to be inflated. A compressor is fluidly coupled with the valve mechanism. The compressor mechanism generates fluid to inflate the device. The compressor mechanism includes a motor to drive a piston, a piston, a piston cylinder, an outlet coupled between the piston cylinder and the valve, and a housing. A biasing spring is positioned in the housing to exert a force on the cylinder. The biasing force maintains the cylinder in a first position when the fluid in the cylinder is at a low pressure. The cylinder moves in the housing against the force of the biasing spring to a second position when the fluid in the cylinder is at a high pressure. A displacement control valve is associated with the cylinder to control the fluid displacement of the compressor. Thus, at low pressure, fluid displacement is high and as pressure in the cylinder increases, the fluid displacement is reduced. A power source is coupled to drive the motor of the compressor.

8 Claims, 6 Drawing Sheets

U.S. PATENT DOCUMENTS 3,024,731 3/1962 Heintz .
3,045,898 7/1962 Hilfing et al. .
3,055,390 9/1962 Scheldorf .
3,109,451 11/1963 Mihalakis .
3,188,964 6/1965 Batten .
3,361,338 1/1968 Carleton .
3,374,944 3/1968 Scheldorf et al. .
3,380,296 4/1968 Malanga .
3,400,885 9/1968 Enemark et al. .
3,403,696 10/1968 Pynchon .
3,429,332 2/1969 Mazeika .
3,447,468 6/1969 Kinne .
3,610,273 10/1971 Russell .
3,618,475 11/1971 Sauder .
3,739,637 6/1973 Novak .
3,889,710 6/1975 Brost .
3,978,884 9/1976 Sundström .
4,039,002 8/1977 Broyan .
4,090,306 5/1978 Darden .
4,388,052 6/1983 Falendysz, Sr. et al. .
4,416,445 11/1983 Coad .
4,507,059 3/1985 Kobayashi et al. .
4,550,749 11/1985 Kirkorian .
4,573,878 3/1986 Ohno et al. .
4,585,207 4/1986 Shelton .
4,621,984 11/1986 Fussell .
4,658,869 4/1987 Soon-Fu .
4,708,606 11/1987 Zambelli .
4,715,787 12/1987 Hung .
4,777,828 10/1988 Ferris .
4,789,310 12/1988 Hung .
4,801,250 1/1989 Lammers .
4,834,632 5/1989 Gatecliff et al. .
4,904,236 2/1990 Redmond et al. .
4,915,594 4/1990 Lammers .
4,934,652 6/1990 Golden .
4,966,035 10/1990 Huang .
5,051,068 9/1991 Wong .
5,213,487 5/1993 Ritchie .
5,231,982 8/1993 Harrison et al. .
5,255,591 10/1993 Gottlieb .
5,266,015 11/1993 Gannaway .
5,275,541 1/1994 Becker et al. .
5,277,560 1/1994 Ritchie et al. .
5,281,782 1/1994 Conatser .
5,387,092 2/1995 Pettitt et al. .
5,417,065 5/1995 Liou .
5,443,370 8/1995 Wang .
5,507,318 4/1996 Israelson .
5,525,045 6/1996 Jang .
5,554,803 9/1996 Huang .
5,568,117 10/1996 Hsu .
5,614,669 3/1997 Sopcisak .

COMPRESSOR MECHANISM FOR A PORTABLE BATTERY OPERATED INFLATOR

BACKGROUND OF THE INVENTION

The present invention relates to inflators and, more particularly, to a compressor mechanism for a battery operated inflator.

Inflators are used with several types of household as well as outdoor devices. Inflators are used to inflate or blow up various items such as bicycle tires, rafts, air mattresses, balls or the like. An inflator can be utilized with an air needle or any type of device which has a standard inflation stem to receive a hose connector. Ordinarily, compressors are used which run from an alternating current supply. In alternating or AC supplied compressor/inflators, it is not necessary to have an efficient compressor since the motor is always running off of a constant current source. Accordingly, these compressors/inflators are very inefficient at low pressure operation. Further, when using a battery operated inflator, as the pressure in the inflator increases, and the compressor mechanism requires more power to obtain the high pressure, the batteries are drained quickly at high pressure operation.

SUMMARY OF THE INVENTION

Accordingly, it is an object of the present invention to provide the art with an inflator which includes a battery operated compressor mechanism which does substantially equal work during each piston cycle independent of increasing pressure in the storage chamber. The present invention provides a compressor mechanism which controls the fluid displacement of its piston during low and high pressure fluid displacement. The present invention also provides the art with an inflator with a compressor mechanism which has a high fluid displacement at low pressure as well as a reduced fluid displacement as pressure increases in a storage chamber.

In accordance with one aspect of the invention, an inflator mechanism comprises a valve mechanism adapted to secure with a device to be inflated. A compressor mechanism is fluidly coupled with the valve mechanism. The compressor mechanism generates fluid to inflate the device. The compressor mechanism includes a motor to drive a piston, a piston, a movable piston cylinder, an outlet between the piston cylinder and the valve mechanism, and a housing. A biasing means, which exerts a force on the movable piston cylinder and is positioned in the housing. The biasing force maintains the cylinder in a first position when fluid in the cylinder is at a low pressure. The piston cylinder moves in the housing against the force of the biasing mechanism to a second position when the fluid in the piston cylinder is at a higher pressure. A displacement control valve is associated with the cylinder. The displacement control valve controls the fluid displacement in the piston cylinder such that at low pressures, fluid displacement is high and as pressure in the storage chamber increases, the fluid displacement is reduced. Also, a power source for driving the motor is coupled with the inflator. Further, the power source of the inflator is a battery. The displacement control valve may be an aperture in the cylinder. In the first position, the aperture is located below bottom dead center position of the piston during cycling of the piston. In the piston cylinder second position, the aperture is positioned above bottom dead center position of the piston during cycling of the piston. Accordingly, increasingly higher pressure results in increasingly increased fluid displacements in the storage chamber.

In accordance with a second aspect of the invention, the inflator mechanism is like that described, however it includes a different displacement control valve. Here, the displacement control valve comprises an expanded portion on the piston cylinder extending from an end of the cylinder a desired distance on the piston cylinder. In the cylinder first position, the expanded cylinder portion is located below bottom dead center position of the piston during cycling. Also, in the second cylinder position, the expanded portion is positioned above the bottom dead center position of the piston during cycling of the piston. Accordingly, increasingly higher pressure results in increasingly decreased fluid displacements in the compression chamber.

In accordance with a third aspect of the invention, a compressor mechanism for an inflator comprises a motor mechanism for driving a piston, a piston, a piston cylinder, an outlet and a housing. A biasing mechanism to exert a force on the piston cylinder is positioned in the housing. The biasing force maintains the piston cylinder in a first position when fluid in the cylinder storage chamber is at a low pressure. The piston cylinder moves in the housing against the force of the biasing mechanism to a second position when fluid in the cylinder storage chamber is at higher pressure which creates a force to overcome the biasing force. A displacement control valve is associated with the piston cylinder to control fluid displacement. Thus, at low pressure, fluid displacement is high and as pressure in the cylinder increases fluid displacement is reduced. The displacement control valve may be an aperture in the piston cylinder. In a first cylinder position, the aperture is located below a bottom dead center position of the piston during cycling of the piston. In the cylinder second position, the aperture is positioned above the bottom dead center position of the piston during cycling of the piston. Ultimately, increasingly higher pressures result in increasingly decreased fluid displacements in the compression chamber.

In accordance with a fourth aspect of the invention, the compressor mechanism for an inflator is the same as above, however, the displacement control valve is different. Here, the displacement control valve is an expanded portion on the cylinder which extends from an end of the cylinder a desired distance on the cylinder. In the cylinder first position, the expanded portion is located below a bottom dead center position of the piston during cycling of the piston. In the cylinder second position, the expanded portion is positioned above the bottom dead center position of the piston cylinder during cycling of the piston. Accordingly, increasingly higher pressures result in increasingly decreased displacements.

Additional objects and advantages of the invention will be apparent from the detailed description of the preferred embodiment, the appended claims and accompanying drawings, or may be learned by practice of the invention.

BRIEF DESCRIPTION OF THE DRAWINGS

The accompanying drawings, which are incorporated in and constitute a part of the specification, illustrate two embodiments of the present invention and, together with the description, serve to explain the principals of the invention. In the drawings, the same reference numerals indicate the same parts.

DETAILED DESCRIPTION OF THE PREFERRED EMBODIMENT

Figure 1:
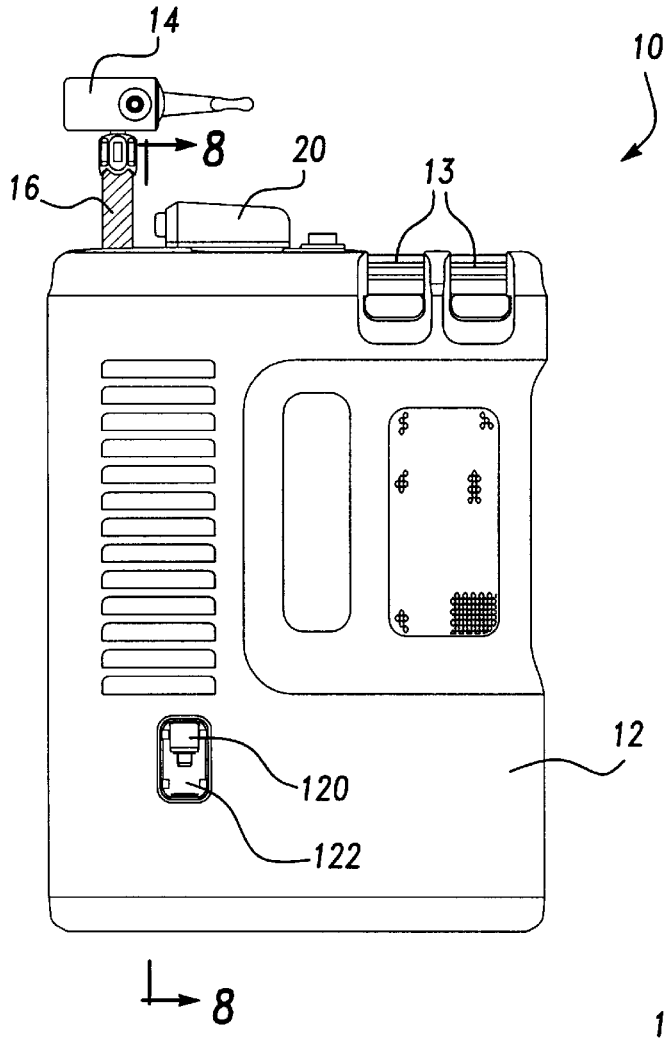
FIG. 1 is a side plan view of an inflator in accordance with the present invention.

Turning to the figures, particularly FIG. 1, an inflator is illustrated and designated with the reference numeral 10. The inflator 10 includes an outer housing 12 and batteries 13. Also a valve connector 14 is illustrated which is secured to a hose 16 which, in turn, is connected to a compressor 18. Further, a storage compartment 20 is secured to the housing 12 to store different types of air inflating devices such as needles or the like.

Figure 3:
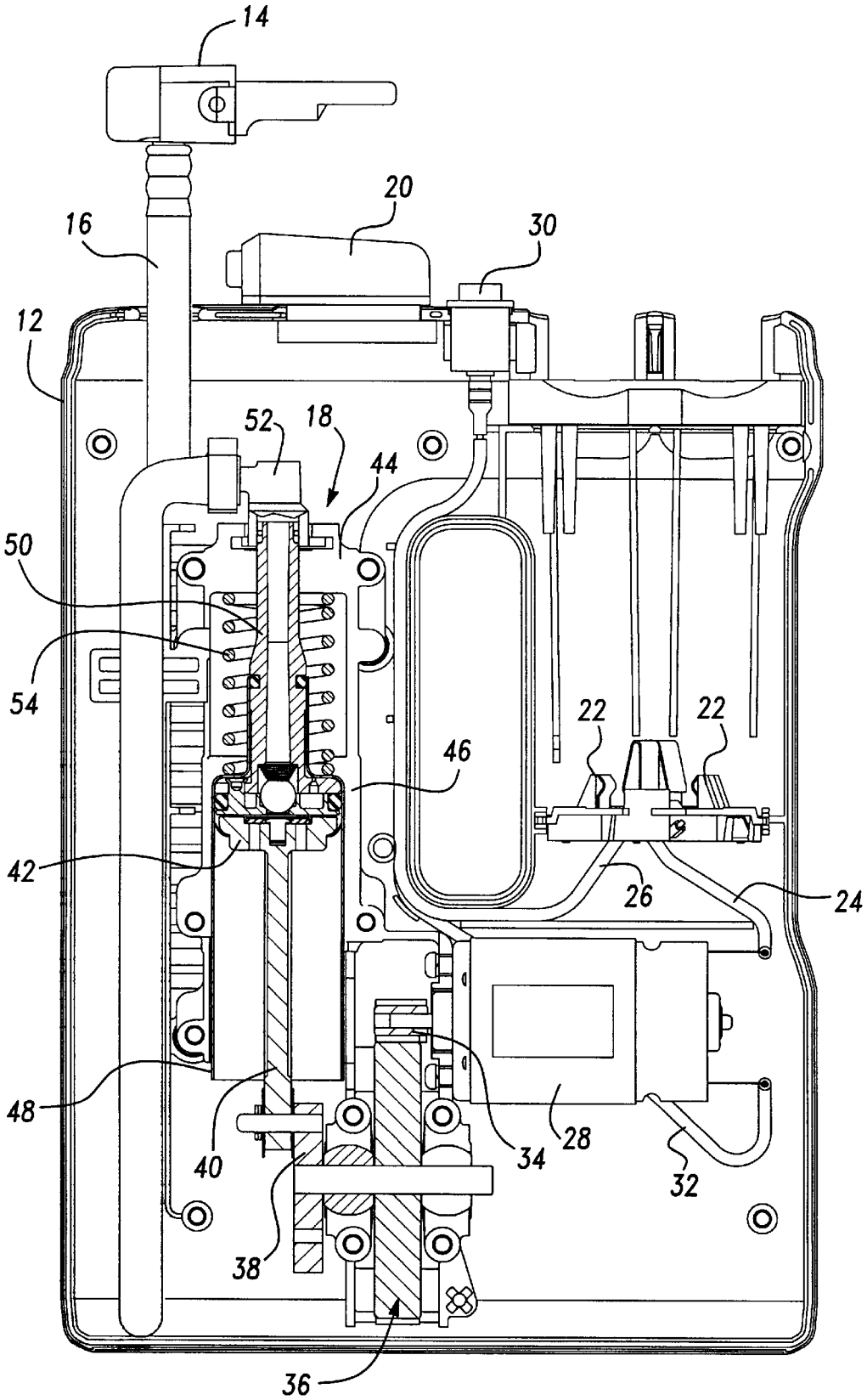
FIG. 3 is a cross-sectional view of FIG. 2 along line 3—3 thereof.

Turning to FIG. 3, a cross-section view of the inflator 10 is shown. The batteries 13 are connected with an electrical connector 22 which includes leads 24 and 26 which lead to a compressor motor 28 and an on/off switch 30, respectively. An additional lead 32 extends between the on/off switch 30 and the compressor motor 28. Accordingly, by moving the switch 30 from an on to an off position, the batteries 13, which act as the power source, deliver current to the motor 28 to energize the inflator 10.

The motor 28 includes a pinion 34 which is connected with a drive gear train 36 which, in turn, is coupled with a crank 38. The crank 38 is coupled with a piston rod 40 which includes a piston 42.

The compressor mechanism 18 includes an outer housing 44 which has a cylindrical portion 46. A piston cylinder 48 is movably positioned within the housing cylindrical portion 46. The piston cylinder 48 slides on an air tube 50. The air tube 50 is coupled with an outlet fitting 52 which, in turn, is coupled with hose 16. A helical spring 54 is positioned within the housing 44 between the housing 44 and piston cylinder 48 around air tube 50. The spring 54 exerts a force onto the piston cylinder 48.

The piston cylinder 48 is ordinarily one piece including a first cylindrical portion 56, shoulder 57, and a second smaller cylindrical portion 58. The smaller cylindrical portion 58 slides along the air tube 50. 0-rings 60 and 62 seal the piston cylinder 48 to create an air storage chamber 70, FIG. 5, as fluid pressure increases in the inflator. A pair of apertures or holes 72 are formed in the piston cylinder 48 on portion 56 and oppose one another. The apertures 72 act as a fluid discharge valve during operation of the compressor 18 as will be discussed herein.

The air tube 50 includes a one-way valve 76. The valve 76 seats on a valve plate 78 which includes passages 80 to enable fluid to enter the storage chamber 70.

The piston 42 includes an outer seal 90. The outer seal 90 seals the piston against portion 56 of cylinder 48. A plurality of bore 94 extend through the piston 42 to enable air to be drawn into a compression chamber 82 within cylinder portion 56. A flap 96 is positioned on top of the bore 94 and acts as a one-way valve enabling air to be drawn into the compression chamber 82 during the downward stroke of the piston 42. The flap 96 prohibits air from escaping the compression chamber 82 during the upward compression stoke of the piston. A rivet or the like 96 maintains the polymeric flap 98 on the piston 42.

Figure 4:
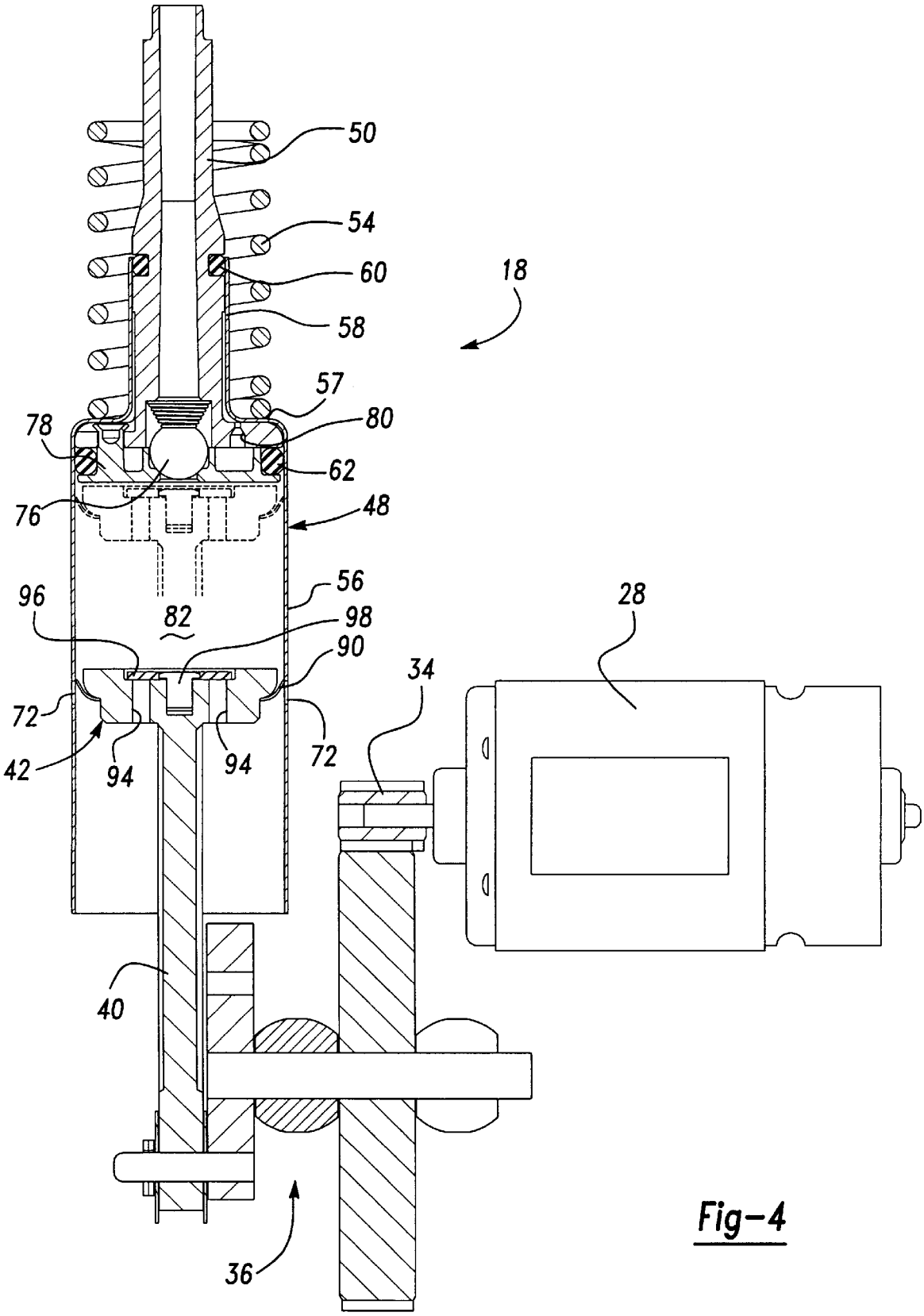
FIG. 4 is an enlarged view of the compressor of FIG. 1 in a low pressure condition with the piston at a bottom dead center position.
Figure 5:
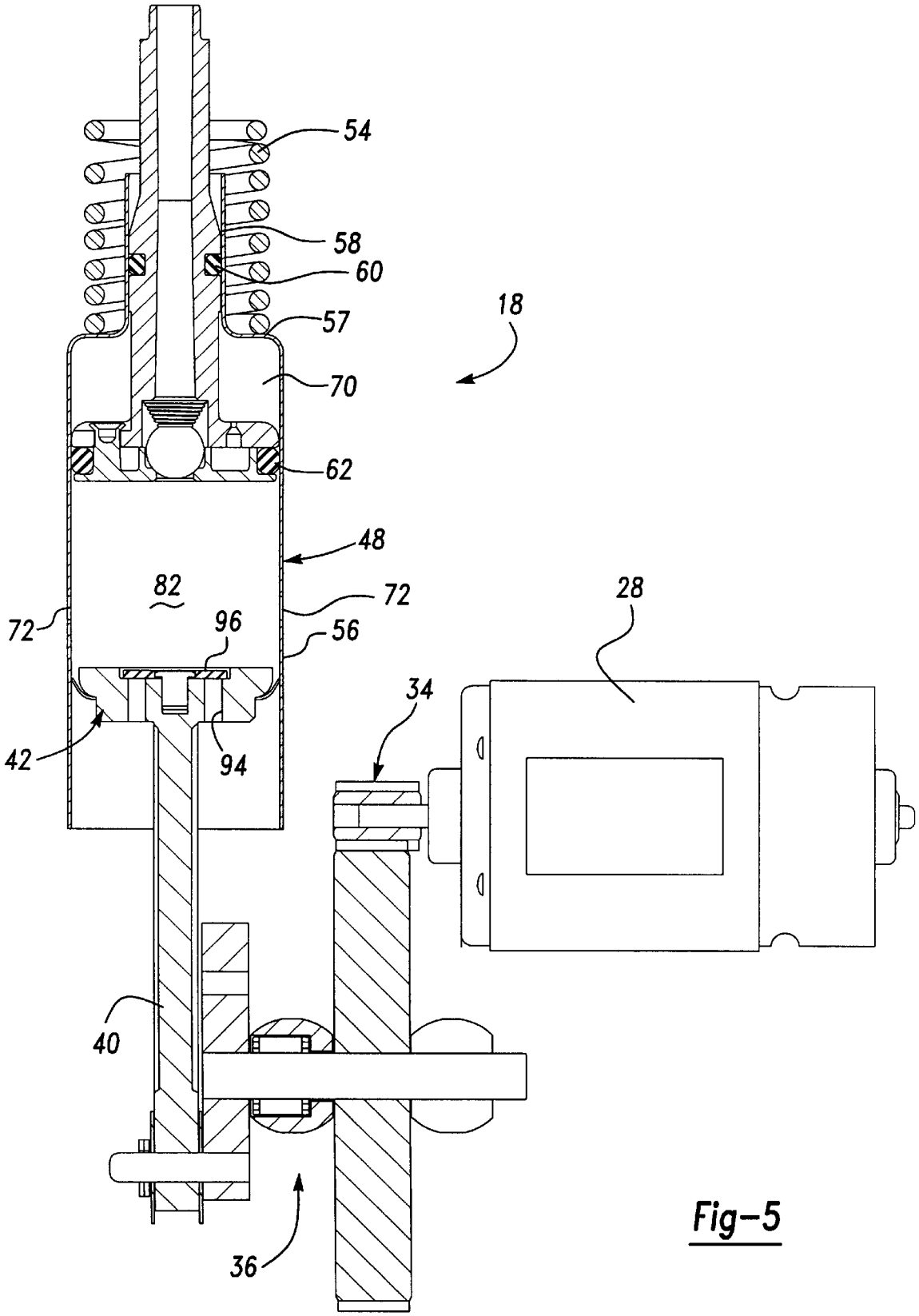
FIG. 5 is a view like that of FIG. 3 in a high pressure condition.

Turning to FIGS. 4 and 5, a better understanding of the operation of the compressor mechanism 18 will be explained.

During low pressure operation of the compressor 18, the spring 54 exerts a force onto the cylinder 48 maintaining the cylinder 48 in a down or first position where the cylinder shoulders 57 rest upon the valve plate 78 of the air tube 50 as seen in FIG. 4. As the piston 42 reciprocates and cycles in the cylinder 48, fluid begins to compress and pass by the ball valve 76 into valve plate 78 through passage 80 and, in turn, into storage chamber 70 of the cylinder 48. As this occurs, the piston cylinder 48 begins to exert a force onto the spring 54 compressing the spring 54. As the spring 54 compresses, the cylinder 48 moves upward as is illustrated in FIG. 5. Thus, the movement of the cylinder 48 will be variable until the storage chamber reaches a maximum pressure. Also, the variable movement of the cylinder is directly related to the pressure in the storage chamber. Accordingly, the cylinder movement may be translated into a PSIG reading and the cylinder used as a pressure gage.

When the compressor 18 is in a low pressure condition, the apertures 72 are below the bottom dead center position of the piston 42 as shown in FIG. 4. As the pressure begins to build in the storage chamber 70, the cylinder 48 moves upwardly in the housing cylindrical portion 46. As this occurs, the apertures 72 begin to gradually rise above the bottom dead center position of the piston 42. Thus, as the piston 42 cycles within the piston cylinder 48, fluid is discharged through the apertures 72 in the compression chamber 82 until the piston 42 rises above the apertures 72. More fluid is discharged as the pressure in the storage chamber 70 increases due to the rise of the cylinder 48 on the air tube 50. Thus, the compressor 18 does substantially equal work during each piston cycle independent of the increasing pressure in the storage chamber 70. This enables the compressor of a given power rating to produce an increased pressure relative to traditional inflators. Thus the present inflator is more efficient during low pressure operation. Further, as the piston cylinder 48 moves upward in the housing cylindrical portion 46, increasingly higher pressures result in increasingly decreased fluid displacements since more fluid is exited from the apertures 72 as the pressure in the storage chamber 70 increases.

Figure 6:
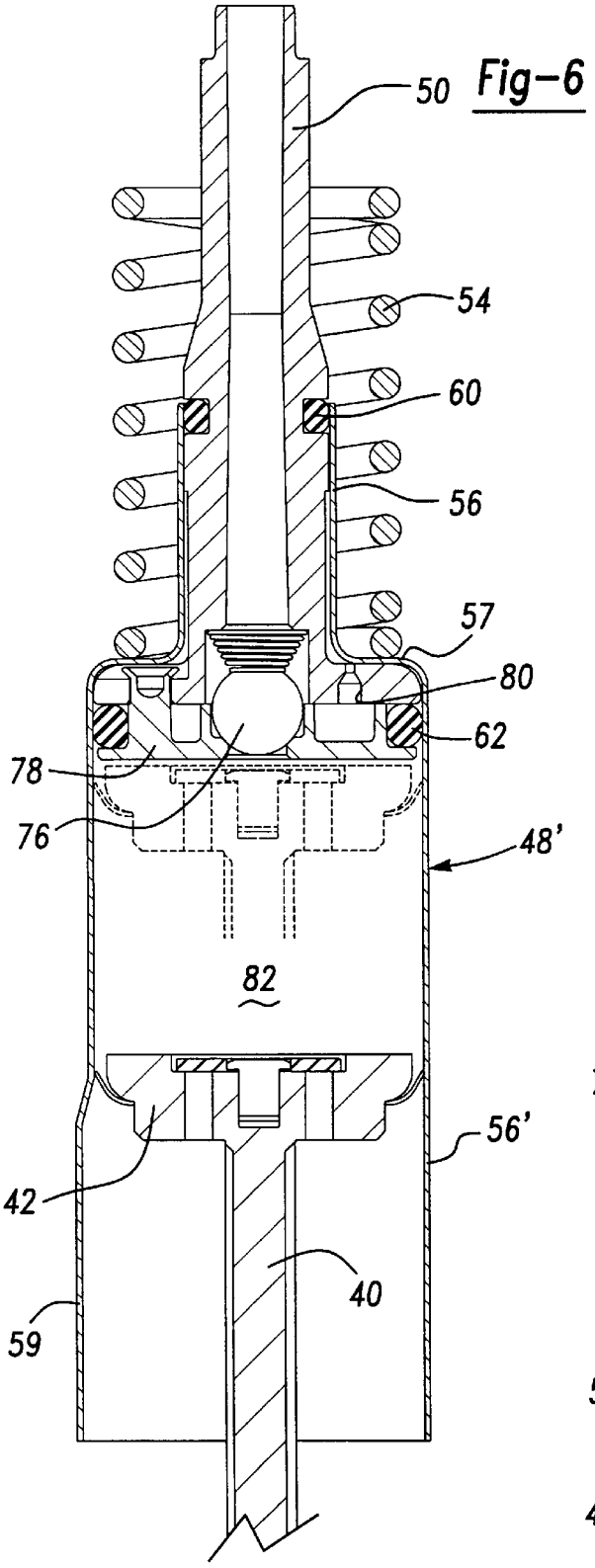
FIG. 6 is a cross-sectional view like that of FIG. 3 of a second embodiment of the present invention in a low pressure condition.
Figure 7:
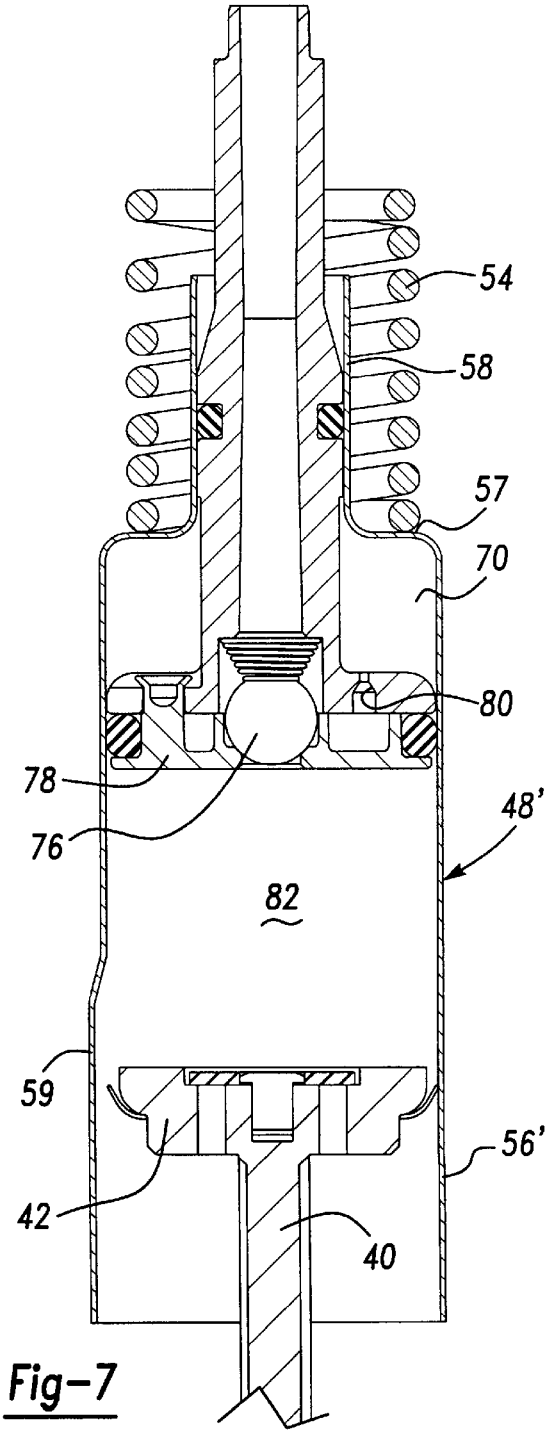
FIG. 7 is a cross-sectional view like that of FIG. 5 in a high pressure condition.

Turning to FIGS. 6 and 7, a second embodiment of the compressor 18 is shown. Here, like elements will be designated with the same reference numerals. Here, the cylinder 48' differs from the cylinder 48 in FIGS. 4 and 5. In FIGS. 6 and 7, the cylinder 48' includes cylindrical portion 56' as well as second smaller cylindrical portion 58. The cylindrical portion 56' includes shoulders 57 adjacent to the cylindrical portion 58. An expanded portion 59 is on the cylindrical portion 56'. As seen in FIG. 6, when the compressor 18 is operating at a low pressure, at bottom dead center of the piston 42, the piston is above the expanded portion 59 such that during the stroke, fluid is compressed throughout the length of the cylindrical portion 56'. As pressure increases and the piston cylinder 48' begins to move upward against the force of the spring 54, the expanded portion 59 begins to rise above the bottom dead center portion of the piston 42 as illustrated in FIG. 7. As this occurs, fluid is displaced out of the compression chamber 82 during the compression stroke of the piston 42. Accordingly, the compressor 18 functions as mentioned above and does substantially equal work during each piston cycle independent of increasing pressure. Further, increasingly higher pressures result in increasingly decreased displacements as explained above.

Figure 2:
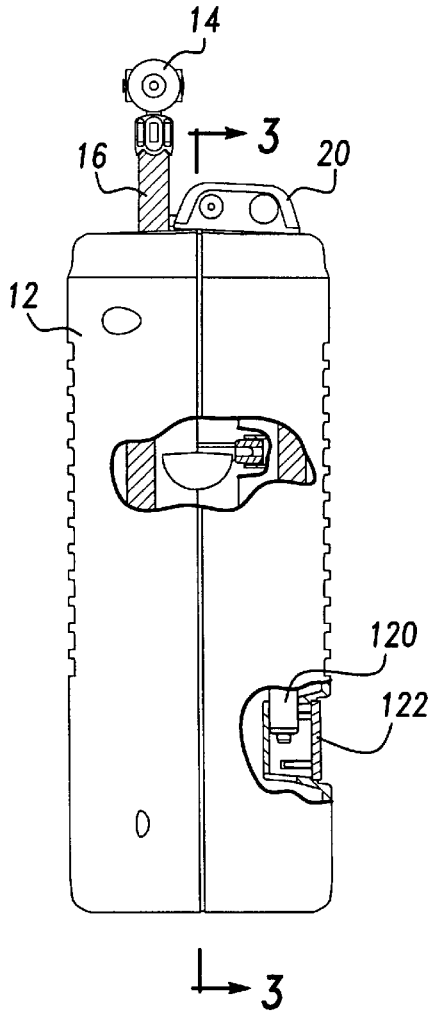
FIG. 2 is a side plan view partially in cross-section of FIG. 1.
Figure 8:
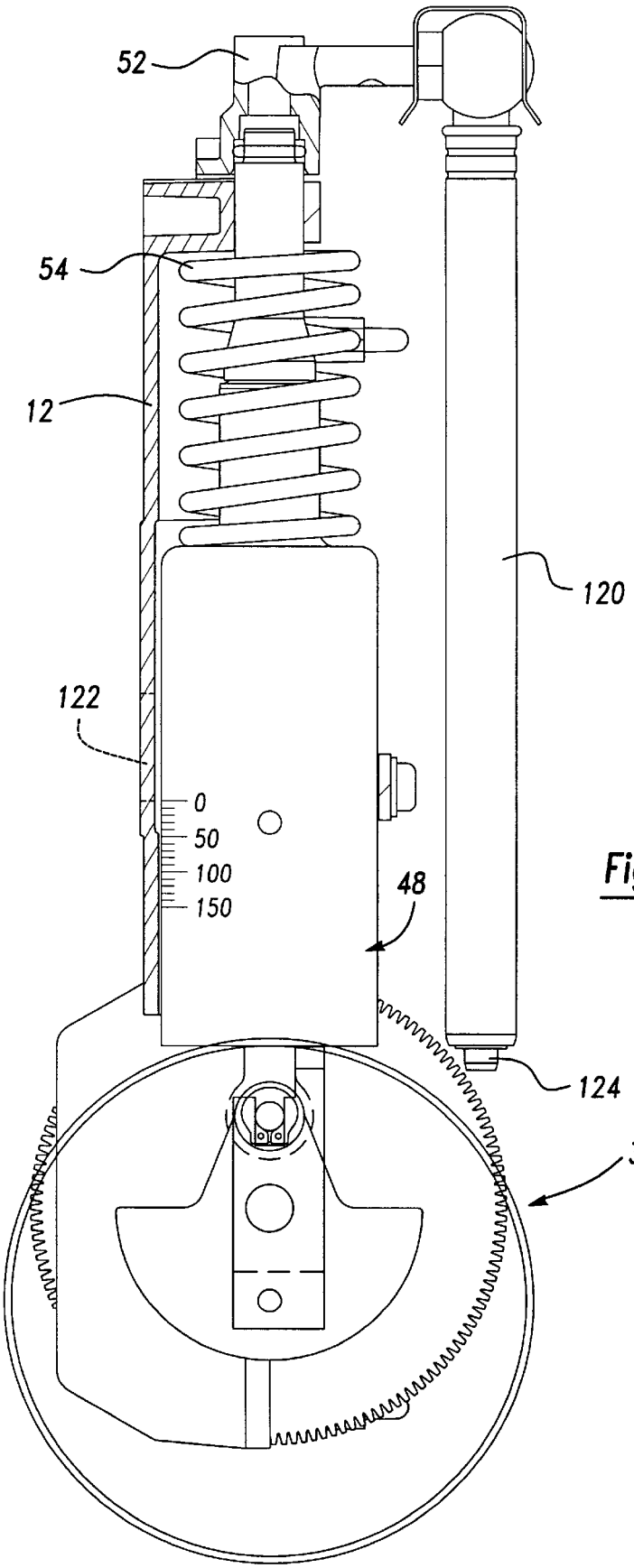
FIG. 8 is a plan view of the compressor of FIG. 1 with a pressure gage.

Turning to FIGS. 2 and 8, a pencil type gage 120 is illustrated connected with the compressor output fitting 52. Here, the pencil gage 120 displays the pressure inside the storage chamber 70. A lens 122 is positioned on the compressor housing 12 so that the pressure stick 124 of the pencil gage 120 can be seen by the user. Alternatively, the pencil gage may be eliminated and the lens positioned so that movement of the cylinder can be seen. Markings would be on the cylinder to indicate the pressure of the storage chamber, as seen in phantom in FIG. 8.

It will be apparent to those skilled in the art that various modifications and variations may be made in the inflator of the present invention without departing from the scope or spirit of the present invention. Thus, it is intended that the present invention cover these modifications and variations provided they come within the scope of the appended claims and their equivalents.

What is claimed is:

1. An inflator mechanism comprising:

a valve mechanism adapted for securing with a device to be inflated;

a compressor mechanism fluidly coupled with said valve mechanism, said compressor mechanism accumulating fluid for inflating the device, said compressor mechanism including a motor mechanism for driving a piston, a piston, a piston cylinder, an outlet coupled between said piston cylinder and said valve mechanism, and a housing;

a biasing member for exerting a force on said cylinder, said biasing member positioned in said housing;

said biasing force maintaining said cylinder in a first position when fluid in said cylinder is at a low pressure and said cylinder moving in said housing against the biasing force of said biasing member to a second position when the fluid in said cylinder is at a high pressure;

a displacement control valve means including an aperture and being associated with said piston cylinder for controlling displacement of the fluid such that, in a first position, the aperture is located below a bottom dead center position of the piston and, in a second position, the aperture is positioned above a bottom dead center position of the piston such that at low pressure, fluid displacement is high and as pressure in the cylinder increases, fluid displacement is reduced; and a power source for driving said motor.

2. The inflator according to claim 1, wherein said power source is a battery.

3. The inflator according to claim 1, wherein said compressor does substantially equal work during each piston cycle independent of increasing pressure.

4. The inflator according to claim 1, wherein increasingly higher pressures result in increasingly decreased displacements.

5. An inflator mechanism comprising:

a valve mechanism adapted for securing with a device to be inflated;

a compressor mechanism fluidly coupled with said valve mechanism, said compressor mechanism accumulating fluid for inflating the device, said compressor mechanism including a motor mechanism for driving a piston, a piston, a piston cylinder, an outlet coupled between said piston cylinder and said valve mechanism, and a housing;

a biasing member for exerting a force on said cylinder, said biasing member positioned in said housing;

said biasing force maintaining said cylinder in a first position when fluid in said cylinder is at a low pressure and said cylinder moving in said housing against the biasing force of said biasing member to a second position when the fluid in said cylinder is at a high pressure;

a displacement control valve including an expanded portion associated with said cylinder for controlling displacement of the fluid such that in a first position, said expanded position is located below a bottom dead center position of said piston and in a second position, said expanded portion being positioned above the bottom dead center position of said piston such that fluid displacement is high and as pressure in the cylinder increases, fluid displacement is reduced; and a power source for driving said motor.

6. The inflator according to claim 5, wherein said power source is a battery.

7. The inflator according to claim 5, wherein said compress does substantially equal work during each piston cycle independent of increasing pressure.

8. The inflator according to claim 5, wherein increasingly higher pressures result in increasingly decreased displacements.

* * * * *

UNITED STATES PATENT AND TRADEMARK OFFICE

CERTIFICATE OF CORRECTION

PATENT NO. : 6,095,762
DATED : August 1, 2000
INVENTOR(S) : Thomas J. Wheeler

It is certified that error appears in the above-identified patent and that said Letters Patent is hereby corrected as shown below:

Column 6, claim 5,
Line 27, after "expanded", insert -- area --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*